United States Patent [19]

Purvis

[11] 4,418,649

[45] Dec. 6, 1983

[54] BOILER STRUCTURE

[76] Inventor: James E. Purvis, Rte. 2, P.O. Box 374, Adel, Ga. 31620

[21] Appl. No.: 438,435

[22] Filed: Nov. 2, 1982

[51] Int. Cl.[3] ..... F22B 5/00

[52] U.S. Cl. ..... 122/15; 122/44 A; 122/136 R; 122/206; 122/353; 122/372; 122/498

[58] Field of Search ..... 126/361; 122/13 R, 4 D, 122/15-17, 19, 44 A, 52, 135 F, 136 R, 158, 353, 162, 203, 206, 372, 498, 497

[56] References Cited

U.S. PATENT DOCUMENTS

| | | | |
|---|---|---|---|
| 112,049 | 2/1871 | Judge . | |
| 132,129 | 10/1872 | Backus . | |
| 220,106 | 3/1879 | Allen . | |
| 347,463 | 8/1886 | Boyer . | |
| 442,563 | 12/1890 | Wells . | |
| 492,290 | 2/1893 | Herbert | 122/203 |
| 494,137 | 3/1893 | Gilbert | 122/203 |
| 498,531 | 5/1893 | Brooks | 122/372 |
| 912,521 | 2/1909 | Allen | 122/372 |
| 953,023 | 3/1910 | Doran . | |
| 1,391,196 | 9/1921 | Law | 122/498 |
| 1,446,145 | 2/1923 | Allan . | |
| 2,003,742 | 6/1935 | Elliott | 122/17 |
| 2,355,466 | 8/1944 | Perry | 122/17 |
| 3,306,268 | 2/1967 | Humanic | 122/498 |
| 3,392,711 | 7/1968 | Wolfersberger | 122/52 |
| 4,154,210 | 5/1979 | Jaymes . | |
| 4,267,801 | 5/1981 | Robinson | 122/4 D |
| 4,268,244 | 5/1981 | Dawson | 122/4 D |

*Primary Examiner*—Henry C. Yuen
*Attorney, Agent, or Firm*—Dowell & Dowell

[57] ABSTRACT

A boiler comprising a long tank lying on its side and having a fire box at one end which is adjacent to a recessed bulkhead that is spaced from a partition in the end of the tank. The top of the tank and two sides thereof extend beyond the bulkhead around the fire box to provide water filled side and top portions for the fire box. The other end of the tank has a rear bulkhead which lies adjacent to a hot gas manifold that extends beyond the rear bulkheads to form a hot gas chamber below a smoke stack. The tank has a number of large diameter tubes extending horizontally between and through the two tank bulkheads to conduct hot gases from the fire box to the manifold chamber and smoke stack. Inside the fire box there is a water filled fuel supporting grate connected by a pump to circulate water from the tank, and between the grate and the front bulkhead there is an upright baffle which extends across the fire box and rises toward the overhanging roof portion but leaves a space above the baffle through which hot gases can pass from the fire box into the flue tubes. The fire box is enclosed by a front partition having ash clean-out doors, controllable air vents adjacent to the grate, and two large water filled doors connected to the tank for circulation. A water jacket surrounds the upper part of the manifold chamber. Helical blades are inserted in the flue tubes to cause the hot gases passing therethrough to whirl, and the flue tubes are all provided with butterfly valves which control the rate of flow of the hot gases from the tubes to the smoke stack.

18 Claims, 8 Drawing Figures

BOILER STRUCTURE

BACKGROUND AND PRIOR ART

This invention provides a boiler structure for burning solid fuels, although it could burn liquid or gaseous fuels. The boiler is intended to recover a much higher proportion of the heat of combustion that is recovered in similar prior art boilers, and seeks to discharge the gases resulting from combustion into the atmosphere at a much lower temperature than is done in the prior art. The boiler is particularly useful for burning wood, such as logs, on a farm to produce hot water that can be circulated through heat exchangers to achieve, for example space heating of living quarters and drying of crops such as tobacco.

The prior art patents on boiler structures used for similar purposes, i.e. to produce hot water or steam, include U.S. Pat. No. 953,023 to Doran which shows a water boiler structure having a fire box at one end which is partly surrounded by water jackets communicating with the boiler and which has a large diameter tube extending from the fire box through the water filled boiler to conduct hot gases therethrough at a rate which is controlled by a valve 30 beyond the fire box. U.S. Pat. No. 220,106 to Allen, and U.S. Pat. No. 1,446,145 to Allan, and U.S. Pat. No. 112,049 to Judge, and U.S. Pat. No. 347,463 to Boyer also show boiler structures having tubes for conducting hot gases through the water in the boiler from a fire box.

The prior art further shows a broad idea of using water filled tubes serving as a grate for supporting the burning fuel, as illustrated in U.S. Pat. No. 4,154,210 to Jaymes, and the above mentioned patents to Doran, Allan and Judge.

The broad idea of using water jackets to partially surround the fire box is shown in U.S. Pat. No. 132,129 to Backus, U.S. Pat. No. 442,563 to Wells, and the above mentioned patents to Doran and Boyer.

However, it is believed that these patents and the other patents of the prior art do not show boiler structures capable of converting the heat of combustion to heat water as efficiently as the boiler structure of the present invention.

THE INVENTION

The present boiler structure comprising a long tank lying on its side and having a fire box at one end which is adjacent to a front bulkhead which is spaced from a partition in the end of the tank. The top of the tank and two sides thereof extend beyond the bulkhead at the fire box to a front partition to provide water filled side and top portions for the fire box. The other end of the tank has a rear bulkhead which lies adjacent to a hot gas manifold that extends beyond the rear bulkheads to form a hot gas chamber below a smoke stack. The tank has a number of large diameter tubes extending horizontally between and through the two tank bulkheads to conduct hot gases from the fire box to the manifold chamber and smoke stack. Inside the fire box, the lower portion of which is lined on its sides and front with brick, there is a fuel supporting grate which comprises a number of water filled tubes arranged horizontally across the bottom of the fire box between opposite header tubes that are connected by piping and a pump to circulate water from the tank, the tubing being somewhat tilted so that convection will cause the water to circulate to prevent overheating even if the pump should fail. Between the grate and the front bulkhead of the tank, there is an upright baffle which extends across the fire box and rises toward the overhanging roof portion formed by the tank. The baffle does not extend to the roof of the fire box, but leaves a space beneath the roof and above the baffle through which hot gases can pass from the fire box into the flue tubes and eventually through the smoke stack. This baffle leans slightly back toward the tank bulkhead and has a brick facing with vertical steel rails located to protect the brick from logs thrown into the fire box. The water filled grate tubing is also protected by horizontal rails disposed to support the logs just above the tubing. The fire box is enclosed by a front partition having ash clean-out doors near its lower end, controllable air vents adjacent to the ash doors, and two large doors through which the fuel is loaded into the fire box. These doors are water filled and connected to the tank by suitable piping and a circulation pump. A water jacket surrounds the upper part of the manifold chamber leading to the smoke stack and is joined to the tank to maintain circulation. Helical blades are inserted in the flue tube to cause the hot gases passing therethrough to whirl with a scrubbing action, and the flue tubes are all provided with butterfly valves which are ganged together and which act to control the rate of flow of the hot gases from the tubes to the smoke stack so as to control the rapidity of combustion as well as the temperature of the discharged stack gases. On top of the tank, which is externally insulated, are located make-up water pipe means, hot water exit piping, and a tank vent. Returning cold water is entered near the bottom of the tank.

OBJECTS AND ADVANTAGES OF THE INVENTION

It is a principal object of the invention to provide an improved boiler structure which burns the fuel more efficiently and extracts a higher percentage of the heat from the gaseous products of combustion so that they are discharged at a lower temperature than is the case in similar prior art boiler structures.

It is another major object of the invention to improve the efficiency of the boiler structure by providing better control over the rate of combustion and the rate of passage of the hot gases in heat exchange relationship with the water tank and flue tubes extending therethrough, whereby the effective dwell time of the hot gases in the boiler can be increased to permit better extraction of heat therefrom.

Still another object of the invention is to provide a boiler structure that has water jackets which are located strategically for recovery of heat from the fire and hot gases so that most of the heat is absorbed by the water therein, which is constantly circulated with the water in the main tank.

It is a further object of the invention to provide a boiler structure in which hot gases are passed through flue tubes in the tank, and in which the gases are made to swirl with a scrubbing action against the surfaces of the tubes.

A further object of the invention is to provide a boiler structure particularly adapted to burn logs. The boiler is protected from damage by rough or careless insertion of the logs in the fire box by providing an upright baffle located between the fire box and the boiler tank and tubes, the baffle being faced with brick to shield the tank bulkhead and flue tubes from excessive heat and from mechanical damage. More particularly, the baffle forces the heated gases to rise against the portion of the tank which comprises the roof of the fire box and mix before the hot gases are drawn downwardly again to pass through the flue tubes after they have left some of their heat behind by exchanging it with the water in the tank at the higher locations near the roof of the fire box. This structure cooperates with the flow control valves for the hot gases through the flue tubes, and permits the logs to be burned more slowly at a lower temperature while still providing optimum heat for the water in the tank, because the longer dwell time in the boiler allows more heat to be extracted from the gases.

Still another object of the invention is to provide a water filled grate to support the fuel, and water filled doors on the fire box so that the heat normally lost through the doors above the grate can be recovered.

A further object of the invention is to provide a boiler structure having multiple large-diameter flue tubes extending through the water tank, and having access doors at both ends of the tubes so that both ends of every tube will be fully accessible for inspection and servicing.

It is a further object of the invention to provide an auxiliary fan in the smoke stack which can be selectively turned on to help start up the boiler when a new fire is being laid, and which can be used to quickly raise the combustion rate of an existing fire when more heat is required. The fan works in cooperation with damper air inlets near the base of the fire box and with flue tube butterfly valves, and is thermostatically controlled.

Other objects and advantages of the invention will become apparent during the following discussion of the drawings.

THE DRAWINGS

FIG. 1 is a left side elevational view of a boiler according to this invention;

FIG. 2 is a longitudinal cross sectional view through the boiler shown in FIG. 1;

FIG. 3 is a front elevational view of the boiler shown in FIG. 1;

FIG. 4 is a rear elevational view of the boiler shown in FIG. 1;

FIG. 5 is a cross sectional view taken along line 5—5 in FIG. 2;

FIG. 6 is a cross sectional view taken along line 6—6 in FIG. 2;

FIG. 7 is a longitudinal cross sectional view taken through the boiler shown in FIG. 1, and corresponds with the right end of FIG. 2 shown on a larger scale; and FIG. 8 is a cross sectional view taken along line 8—8 in FIG. 2 on an enlarged scale.

DESCRIPTION OF THE DRAWINGS

Referring now to the drawings.

Figure 1:
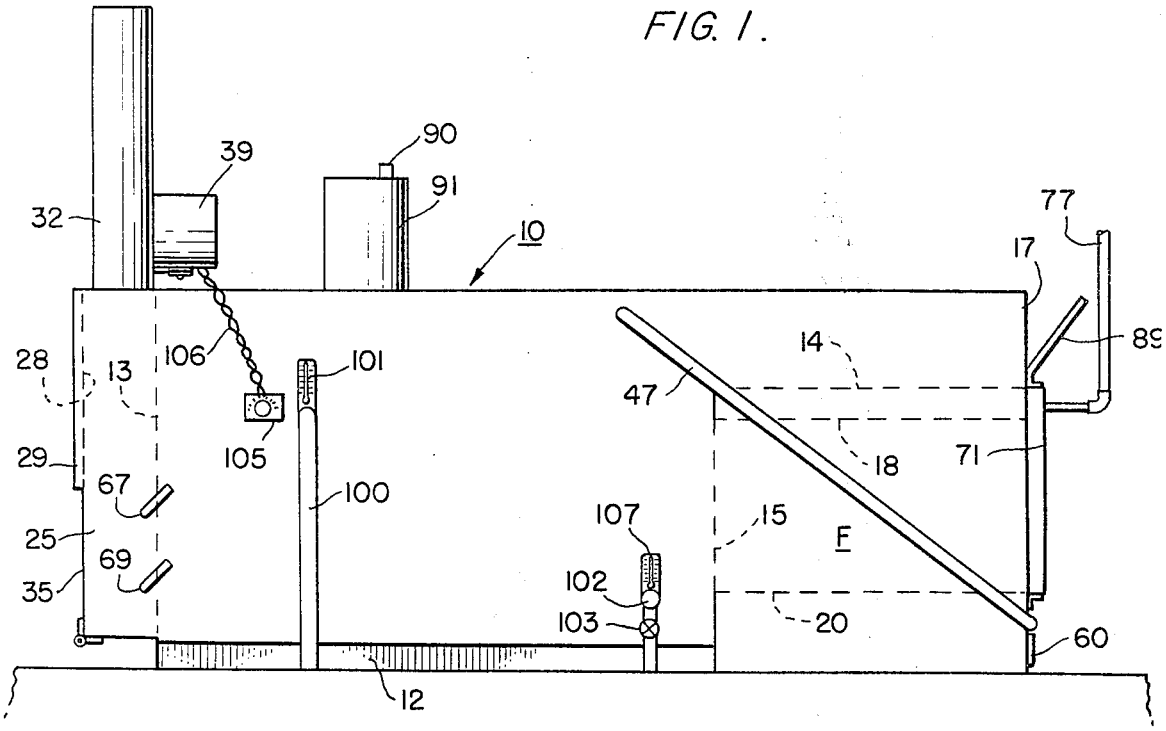
FIGS. 1 and 2 show views of a preferred embodiment of the invention which comprises a large water tank 10 which is cylindrical and lies on its side in a concrete cradle 12. The tank has a rear bulkhead 13 at its smoke stack end as can be seen best in FIGS. 2 and 5, and has a front bulkhead 15 at the fire box end of the tank as can be seen best in FIGS. 2, 6 and 7. The front bulkhead 15 is inset in the tank which extends beyond the bulkhead and ends at a front partition 17. As is illustrated in FIG. 6, the sides of the tank 19 beyond the bulkhead 15 are not cylindrical, but are extended downwardly opposite each other to form a fire box F. The inside top of the fire box F is formed by a horizontal plate 14 welded to the bulkhead 15 as shown in FIG. 7, and the side walls of the fire box are formed by plates 16 which are welded to the face of the bulkhead 15 at their rear edges and to the front partition 17 at their front edges, and which are joined to the top plate 14 by diagonal plates 18. The bottom edges of the plates 16 are joined by plates 20 to form water-filled side portions of the tank on each side of the fire box F. Circulation of water between the tank and these side portions is provided by weep holes 22 in the bulkhead, FIG. 6. The outer sidewalls 19 of the fire box F below the horizontal plates 20 are lined with brick 24 to insulate the walls from the fire and keep the heat inside the fire box, and the bottom of the fire box is provided with a concrete floor 23, although a dirt or sand floor would serve satisfactorily.

The two tank bulkheads 13 and 15 are provided with aligned patterns of holes including five smaller diameter holes and four larger holes below them, and these holes have longitudinal flue tubes 26 and 27 welded through them as can be seen best in FIGS. 2, 5, 6 and 7. The top row includes five flue tubes 26 which are 10 inches in diameter, and the bottom row includes four flue tubes 27 which are 12 inches in diameter.

Figure 2:
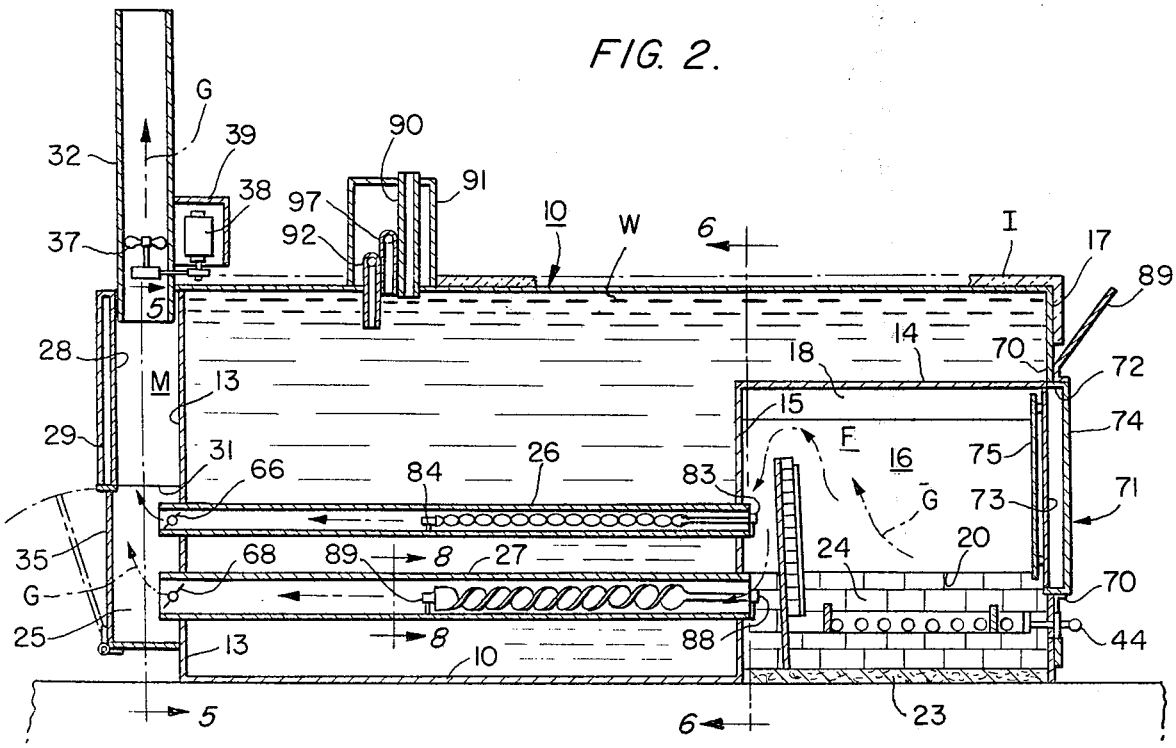
Figure 4:
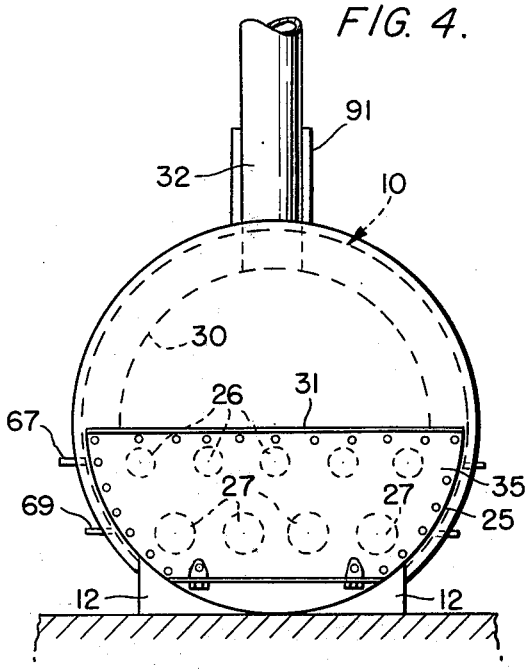
Figure 5:
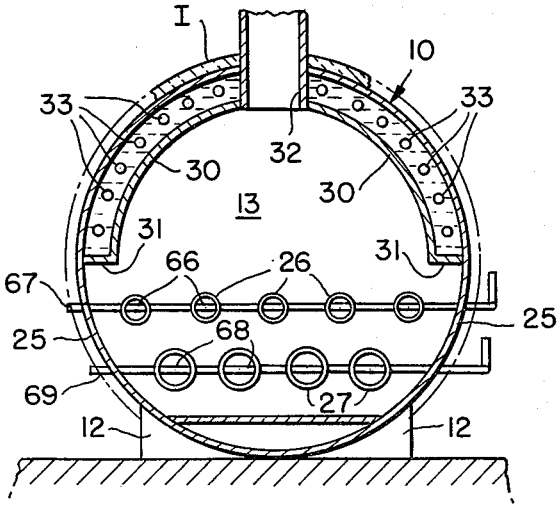
Figure 6:
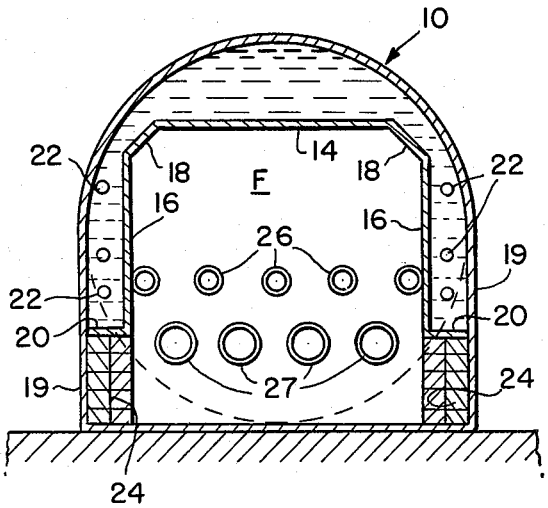

Behind the rear bulkhead 13 of the tank there is a hot gas manifold chamber M formed by a vertical rear partition 28, FIGS. 2 and 4 which is jacketed on its upper outer surface by a water jacket 29. As can be seen in FIG. 5, the jacket 29 is connected to the main tank 10 through weep holes 33 by two side water jackets 30 which have plates 31 closing their bottoms. The jackets 30 have an opening through which a smoke stack 32 extends. The lower half of the rear partition 28 of the boiler comprises an openable door 35 permitting access to the ends of the flue tubes 26 and 27 for service and cleaning. In the smoke stack 32 is located a fan 37 driven by an electric motor 38 which is under a protective cover 39.

Figure 7:
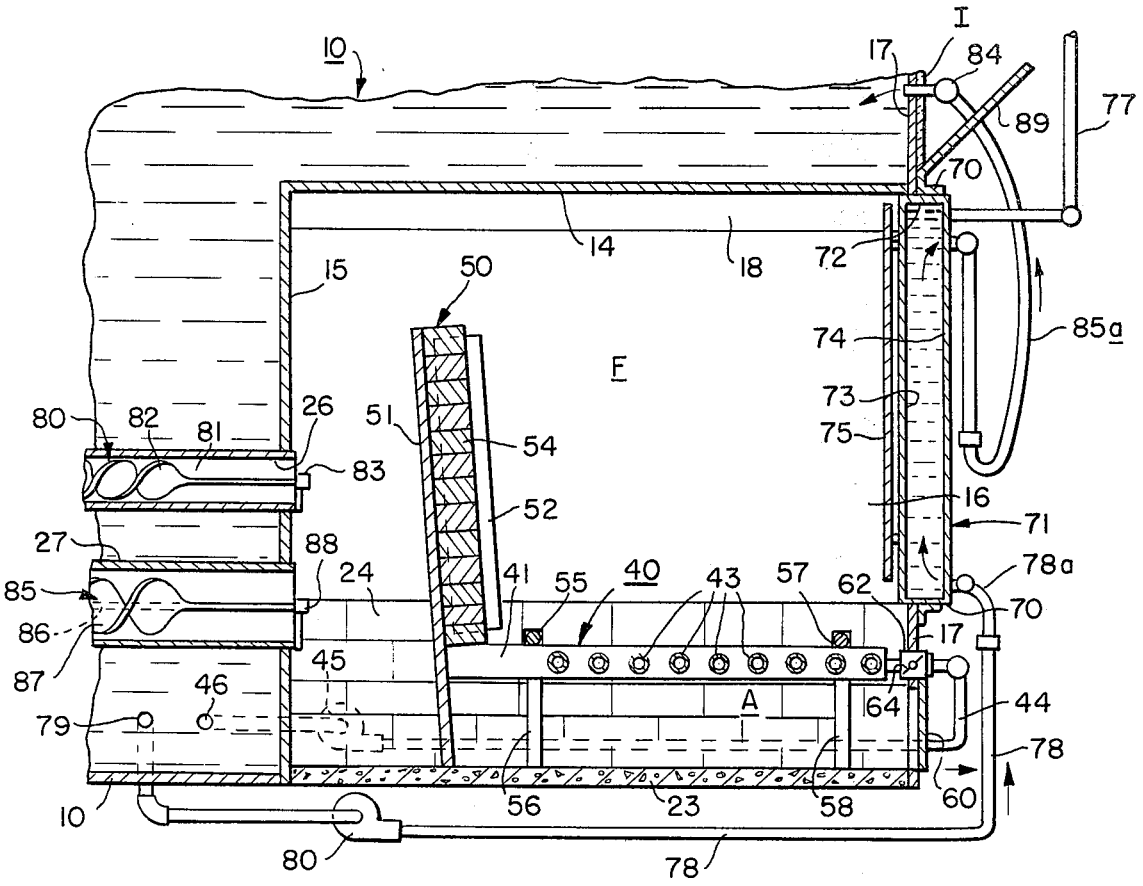

Referring again to the fire box F, FIG. 7, a grate 40 is provided by two longitudinal horizontally-spaced header pipes 41 which have welded between them a number of smaller diameter cross pipes 43 which communicate into the header pipes 41 and are water filled. One of the header pipes is connected through a pump 45 taking water from a pipe 46 near the bottom of the tank 10 and pumping it continuously through a pipe 44 into that header 41 and through the cross pipes 43 and out through the other header 41 and through a pipe 47 back into the main tank 10 near its top, as can be seen in FIGS. 1 and 3.

The rear ends of the headers 41 are closed and welded to a baffle 50 comprising a plate 51 inside the fire box F which stands upright but leans somewhat toward the bulkhead 15. This plate has several railroad rails 52 welded upright to it to stop logs thrown onto the grate 40 from damaging a facing of brick 54 which protects the baffle plate 51 from heat damage by the fire. The grate 40 is supported above the floor 23 by suitable legs 56 and 58 which are welded to the header pipes 41. The legs can also be attached to cross beams 55 and 57 which serve to confine the logs on the grate and space them from the front partition 17 and from the baffle 50.

Figure 3:
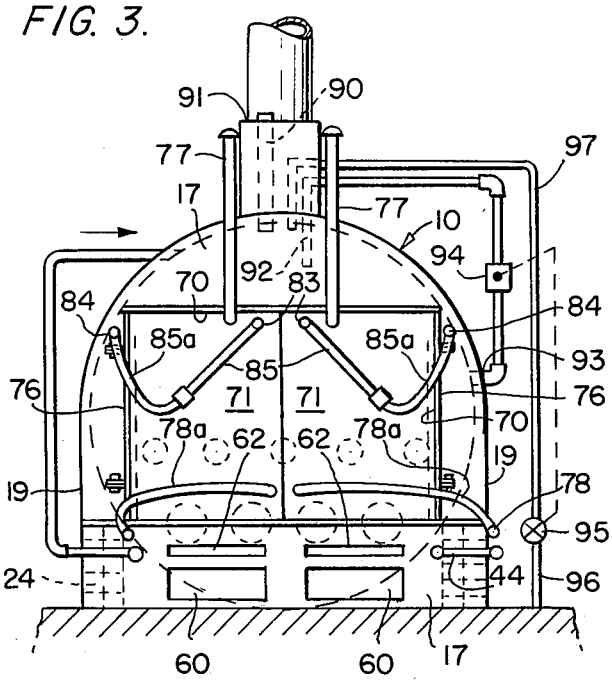

As can be seen in FIGS. 3 and 7, the front partition 17 is provided with two openings that are closed by doors 60 which provide clean-out access to the ash pit A below the grate 40 and above the floor 23. Above the ash doors 60 are two horizontal air vent slots 62 whose openings are controlled by butterfly valves 64 to control the amount of air going into the fire box F. Moreover, at the rear ends of the flue tubes 26 and 27 are butterfly valves 66 and 68, FIGS. 2 and 5. The butterfly valves 66 are all ganged together and controlled in unison by a rod 67 and the butterfly valves are ganged together and controlled in unison by a rod 69, and these rods extend to handles located outside of the housing 25 that encloses the end of the tank together with the partition 28 to make an air-tight manifold smoke chamber M that will draw properly in cooperation with the smoke stack 32. In ordinary operation, after a start-up period, the butterfly valves 64, 66 and 68 control the rate of burning of a fire on the grate 40. The fan 37 is normally used only during start-up of a new fire, or when needed to rapidly increase the rate of combustion as will be more fully discussed hereinafter.

Figure 8:
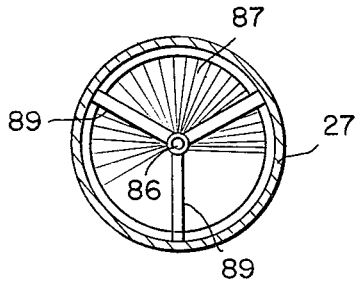

Inside each of the flue tubes 26 and 27 there is located just back from the front of the tube an auger insert which serves to cause the hot gases to swirl in the tube with a scrubbing action which increases the contact of the hot gases with the walls of the tube to increase heat transfer from the gases to the tube. These augers can best be seen in FIGS. 2, 7 and 8. The auger insert in tube 26 is labeled 80 and includes a rod 81 with a sheet metal helix 82 around it. The end of the rod 81 is supported just inside the fire box at the end of the flue tube 26 by a standoff having a socket 83 into which the end of the rod 81 is inserted for support. The other end of the auger 80 is supported by a tripod 84 attached to the rod 81. The tripod legs just fit inside the tube 26, and the auger helix 82 has a small clearance with the inside wall thereof. The auger 80 can be pulled out of the tube 26 through the door 35 at the rear of the boiler as seen in FIG. 2. The lower augers 85 inside each tube 27 are larger in diameter. They also each comprise a rod 86 around which a sheet metal helix 87 is wound, the end of the rod 86 located at the fire box being entered in a socket 88 supported on a standoff welded to the tube 27, while the other end of the rod 86 has attached to it a tripod 89 which can be seen best in FIG. 8. Each auger 85 is likewise removable from the tube by merely pulling it out leftwardly through the door 35 as seen in FIG. 2.

At the front of the boiler, as shown in FIGS. 2, 3 and 7, the front partition 17 has a large opening 70 through which fuel is loaded onto the grate 40. This opening 70 is closed by two water filled doors 71 which are formed of a frame 72 with two spaced plates 73 and 74 welded to it to form a water jacket. Inside the fire box F, and attached to the plates 73 by spacers are heat shield plates 75 to protect the doors from the direct heat of the fire. In this embodiment of the invention, the doors are hinged vertically at their outer edges, although if desired the doors could be hinged horizontally along their upper edges and counterweighted so that when opened they are out of the way when loading logs onto the grate, for instance using a front-end loader or a chain chute. As presently illustrated the doors are vertically hinged as at 76. Each door has a breather pipe 77 extending from the top of its jacket, and has a pipe 78 entering at the bottom of its jacket and supplied by water taken from the bottom of the tank 10 by a pipe 79 and circulated by a pump 80. A portion 78*a* of the pipe 78 is made flexible to permit opening of the doors without disconnecting the water source. Near the tops of the door jackets are pipe fittings 83 which carry out the hot water and deliver it back into the main tank 10 though fittings 84 and a flexible portion 85*a* of the pipes 85. Above both doors 71 there is a protective heat deflector plate 89, as shown in FIGS. 1, 2 and 7, which deflects flame and heat away from exterior insulation on the front of the partition 17 when the doors are opened.

The main tank 10 of the boiler is not filled completely, but has a water level W a few inches down from the top as shown in FIG. 2. The top of the tank is vented to the atmosphere by a vent tube 90, which extends up through a housing 91 secured to the top of the tank 10, and which makes it virtually impossible to develop enough steam pressure in the tank to accidentally blow it up. This housing, as seen in FIGS. 2 and 3, also contains two other pipes which enter the tank. The pipe 92 extends into the water in the tank and is part of a water level measuring loop that includes a lower pipe 93 and a water level switch 94. When the water level in the tank 10 falls below a set level, the switch 94 opens a magnetic valve 95 and permits water from a pressure pipe 96 to enter the tank 10 through a pipe 97 to provide the correct amount of makeup water, about two gallons a day when the boiler is in full use. As can be seen in FIG. 1, water is taken from the boiler tank through a pipe 100 leading to the place of use, such as heat exchangers (not shown) in a tobacco drying barn, and a thermometer 101 shows its temperature. The water from the heat exchangers is returned to the boiler tank by way of the pipe 102 through a check valve 103, its temperature being shown by the thermometer 107. In addition, a thermostat 105 measures the temperature of the water near the outlet pipe 100 and is connected by wiring 106 to operate the stack fan automatically if the heat level falls below the set temperature of the thermostat 105. All outside surfaces of the boiler, and the pipes leading into and out of its tank, are insulated with insulating material I, which in the embodiment manufactured comprises sprayed insulation.

OPERATION

The boiler shown in the drawings is designed to burn logs, although any other fuel could be efficiently burned and suitable conversions can be easily made in the grate structure. The logs are entered into the fire box F and placed transversely on the grate 40 across the headers 41 so that they lie between the baffle 50 and the doors 71. The railroad rails 52 on the baffle protect the brick facing thereon from damage by logs dumped onto the grate, and the cross beams 55 and 57 shown in FIG. 7 tend to center the logs and keep them away from the baffle and the doors. The water filled pipes 43 of the grate are spaced apart so that ash from the burning logs can fall into the ash pit A from which the ash can be removed through the ash doors 60. As the logs burn, the hot gases of combustion rise to heat the water in the tank above the plate 14 and the water at both sides of the fire box F confined by the side plates 16. In addition, the fire also heats the water in the water filled doors 71, although protective shield plates 75 deflect some of the heat from the doors. The heating of the water above the plate 14 and outside of the plates 16 causes the water to circulate with the water in the main tank 10 through weep holes 22, FIG. 6. However, the water in the doors 71 is normally pumped by the pump 80 to achieve a high degree of circulation with the water in the main tank 10. A centrifugal pump 80 is used instead of a positive displacement pump so that in the event of an electrical power failure the water will still circulate by convection in adequate quantity to prevent heat damage to the doors. The doors are coupled to the circulation pipes 85 and 78 by flexible lengths of high temperature hose 85*a* and 78*a* so that the doors can be opened to insert fuel. A vent pipe 77 extends upwardly above each door from the tops of their water jackets to insure that no air bubbles will accumulate in the jackets. A heat deflector plate 89 extends across the boiler above the door openings to protect the insulation I on the outside of the front of the boiler from heat and flame damage when the doors are open. In addition, water is circulated through the headers 41 and the pipes 43 of the grate 40 to carry heat from the grate to the tank which receives the heated water through the pipe 47, FIGS. 1 and 3. Here again, a centrifugal pump 45 is used so that water can circulate by convection in order to maintain adequate flow in case of an electrical power failure.

As shown by the arrows G in FIG. 2, the hot gases rise upwardly from the fire and collect high in the fire box above the baffle 50, which extends all the way across the fire box F. The gases are then drawn downwardly into the flue tubes 26 and 27 through which they pass before eventually escaping vertically through the smoke stack 32. The manner of passage of the gases, and the effect of the gases on the boiler is discussed more thoroughly below.

The flue tubes through the tank 10 are made quite large in diameter, ten inches for the tubes 26 and twelve inches for the tubes 27. Inside these tubes are helical inserts 80 and 85 which make the hot gases G swirl against the surfaces of the tubes with a scrubbing action to increase the transfer of heat from the gases to these surfaces. These inserts 80 and 85 are removable from the rear ends of the tubes 26 and 27 after disassembly of the butterfly valves 66 and 68 which are accessible through the open door 35. The water jackets at the rear of the boiler as seen in FIG. 5, and to the left in FIG. 2, serve to recover whatever heat remains in the gases G after they emerge from the tubes 26 and 27. The jacket 28,29 on the rear panel of the boiler is coupled by two side jackets 30,31 that are connected by weep holes 33 with the water in the main tank 10, and the hot gases leaving the flue tubes 26 and 27 are in heat-exchange relationship with these jackets as they pass upwardly to the smoke stack 32. It is the principal object of this invention to recover as much heat from the fire as possible, and these jackets 28, 29, 30 and 31, and the remainder of the boiler structure absorb so much heat that the gases finally leaving the flue depart at only about 200° F.

The stack fan 37 serves to insure flow of the gases when needed. For instance, when a fire is first started in a cool boiler, the fan maintains flow through the gas path G until the boiler and the water reaches temperatures sufficient to sustain convection that will cause adequate draw throughout the gas path from the air inlet vent slots 62 to the smoke stack 32. For this purpose, a thermostat 105 measures the water temperature and turns off the fan when the temperature reaches the set temperature. Moreover, if the water temperature falls, the thermostat 105 will start the stack fan 37 again to increase the rate of combustion and heat transfer and raise the boiler temperature. The flow of air into the fire box can be controlled by the air slot butterfly valves 64, and in addition the flow of hot gases G through the tubes 26 and 27 can be further controlled by the butterfly valves 66 and 68 from outside the boiler using the rods 67 and 68 whose ends are bent at right angles to form handles which indicate the positions of the valves shown in FIG. 5.

Hot water is taken from the boiler by one or more pipes such as the pipe 100, which goes to external equipment (not shown) such as pumps and space-heater heat exchangers. The returning water is introduced into the tank 10 by one or more pipes such as the pipe 102 which contains a check valve 103 to prevent backflow. Thermometers 101 and 107 serve to indicate the temperature of the departing and returning water so that the efficiency of the external heating equipment can be watched.

The manner of flow of the hot gases G from the fire through the fire box, over the baffle 50, through the tubes 26 and 27, and up the smoke stack 32 contributes to the goal of extracting as much heat as possible from the burning fuel. This flow is controlled both as to its velocity therethrough and as to its path of flow so as to not only increase its contact with the heat exchange surfaces in the boiler, but also to increase its dwell time in contact with them. As can be seen in FIGS. 2 and 7, the hot gases from the fuel burning on the grate rise upwardly in the fire box toward the plate 14 and remain there long enough to mix with the other hot gases already there before being drawn downwardly behind the baffle 50 to enter the flue tubes 26 and 27. This causes both mixing of the very hottest gases and also a considerable dwell time of the gases at this high temperature location before the gases are drawn downwardly behind the baffle 50. This is a major feature of the invention because it insures complete burning of any solid particles or vapors entrained in the gases before they are drawn down into the flue tubes 26 and 27. As a result, the gases entering the flue tubes are substantially smokeless and clean so that the tubes and subsequent surfaces in the gas path remain clean for efficient heat exchange. Moreover, the longer dwell time in the fire box F caused by the undulating path of the hot gases therein increases the extraction of heat therefrom by the boiler plates.

Another very important improvement contributed by the baffle 50 is that the baffle forces all of the gases drawn through the flue tubes to come from a level near the top of the fire box F. If the baffle were removed, the tubes 26 and 27 would tend to draw cooler gases from lower levels in the fire box F since the air vent slots 62 are almost on the same level as the lower tubes 27. If these cooler gases were drawn into the tubes 26 and 27 there would be poorer heat transfer to the tubes, but more importantly, partially burned vapors and smoke particles would be drawn into the tubes and would soon cake them with an insulating layer of gum and smoke particles to reduce their capacity as heat exchanger surfaces.

The butterfly valves 64 in the air vent slots, and the butterfly valves 66 and 68 in the flue tubes, permit a very flexible degree of control over the combustion of the fuel and the rate of flow of the hot gases therefrom. In a boiler system without such valves, the only control over the rate of passage of the gases over the boiler surfaces would be the heat of the fire itself, which is not quickly and easily controlled. In the present boiler, the valves 66 and 68 can be adjusted to throttle the flow of hot gases through the boiler so that they will remain in the fire box F and in the hot gas manifold M, and in the tubes 26 and 27 between them, for a time sufficient to extract as much heat as possible from the gases. As mentioned above, when the boiler is started up cold it will not draw from the fire box through the paths G, so that the stack fan must be run until the surfaces are heated sufficiently to sustain adequate draw. Once it is drawing properly the fan is turned off by the thermostat 105 and then the butterfly valves remain in control of the flow of gases and the combustion rate of the fuel. With the valves closed the fire would be denied air and would eventually be extinguished. With the valves partially closed the combustion rate can be slowed to bank the fire or increased to raise the heating rate of the water in the boiler. Fresh air is introduced through the air vent slots 62 and can be controlled by the butterfly valves 64.

However, when the doors 71 are opened, the valves 64 are no longer in control of the entrance of air, and the fire box temperature may drop greatly. When this occurs, cooled gases can be drawn into the flue tubes 26 and 27 which would chill them and the gas manifold chamber M. Therefore, the butterfly valves 66 and 68 should be closed before opening the doors 71 to refuel the grate, and then reopened after the doors 71 are again closed. During normal use of the boiler when a fire is well established, the butterfly valves 26 and 27 should be positioned to maintain the rate of flow of hot gases at a rate necessary to extract maximum heat therefrom without so cooling them that the manifold M and the stack 32 will not draw. Such control has the effect of also controlling the rate of burning of the fuel to be economical and efficient. A relatively slow rate of combustion can still produce adequate boiler heat because of the efficient collecting and mixing of hot gases in the fire box F above the logs caused by the presence and shape of the baffle and by the undulating path of the hot gases G. In cases where the fire is banked and slow burning, one set of tubes 26 or 27 can be completely closed so that the rate of gas flow in the other set of tubes can be maintained at an efficient level. When the rate of heating is to be increased using a hotter fire, the closed set of tubes would then be opened so that the greater volume of hot gases can pass through the greater number of tubes without raising the rate of flow in any of the tubes. In all cases, the rate of combustion and gas flow can be changed quickly by closing the butterfly valves, or by opening them wider and boosting the combustion rate and flow by running the stack fan.

This invention is not to be limited to the exact embodiment shown in the drawings and described, for changes may be made within the limitations of the following claims.

I claim:

1. An improved boiler for burning fuel to heat water, comprising:

(a) a horizontal water tank having a rear bulkhead at its rear end, having a second bulkhead which is recessed in the tank spaced from its front end to form a fire box, the second bulkhead extending partway up the height of the tank to leave a top portion of the tank overhanging said fire box and closed by a horizontal plate, the tank having spaced opposed side portions extending on both sides of the fire box from the second bulkhead to the front of the tank, the side and top portions of the tank being substantially water filled and communicating with the water in the tank, and the tank having multiple horizontal flue tubes extending longitudinally through the tank below its center and through the bulkheads and sealed thereto;

(b) a hollow water filled grate in the fire box located between the tank side portions and below its top portion, and means to circulate water from the tank through the grate;

(c) a front partition extending down from said top portion and transversely between said side portions and closing the front of the tank and the fire box, said front partition having doors located between said side portions and disposed for access to the fire box to load fuel on said grate, the doors being water filled and having means to circulate water from the tank through the doors, and the front partition having ash clean-out doors located below said grate;

(d) a gas manifold chamber enclosing said rear bulkhead of the tank and having a smoke stack extending therethrough above the tank; and (e) an upright baffle extending transversely across the fire box and located between the grate and the second bulkhead and extending from the bottom of the fire box above the grate to a level higher than the level of the highest flue tube but below the level of said horizontal plate, whereby hot gases from the fire box will collect and mix near the level of the plate in front of the baffle before being drawn downwardly again to enter the flue tubes to the rear of the baffle.

2. In a boiler as claimed in claim 1, said baffle being located toward the rear of the fire box nearer to the second bulkhead than to the front partition.

3. In a boiler as claimed in claim 1, said baffle comprising a metal plate having a layer of brick facing the grate and having vertical metal rails extending from the brick toward the grate to protect the brick from mechanical damage.

4. In a boiler as claimed in claim 1, said multiple tubes which extend through the tank and the bulkheads being arranged in plural horizontal rows at different levels below the centers of the bulkheads, and each tube having a butterfly valve therein, and the butterfly valves in each of the horizontal rows being ganged together for unitary control in that row.

5. In a boiler as claimed in claim 4, said butterfly valves being located in the tubes within said gas manifold chamber, and the gas manifold having door means therethrough located opposite said tubes for access to the tubes.

6. In a boiler as claimed in claim 1, said gas manifold chamber having water jackets in its upper portions located opposite said rear bulkheads and on both sides of the smoke stack, and the jackets communicating with the water in the tank through said rear bulkhead.

7. In a boiler as claimed in claim 1, a fan in said smoke stack operative to draw gases from the chamber, the tubes, and the fire box; and thermostat means measuring the temperature of the water in the tank and connected to turn on the fan when the water temperature is below a set temperature.

8. In a boiler as claimed in claim 1, said grate comprising spaced longitudinally-extending headers located between the baffle and the front partition, and having multiple transversely extending pipes coupled between the headers, a header on one side of the fire box being connected to receive water from a point low in the tank, and a header on the other side of the fire box being connected to deliver water to a point high in the tank to sustain flow by convection.

9. In a boiler as claimed in claim 8, pump means connecting the grate and the tank to circulate water therebetween.

10. In a boiler as claimed in claim 1, said water filled doors supporting heat shield plates spaced therefrom and located between them and the fire box grate to protect the doors from the direct heat of the fire.

11. In a boiler as claimed in claim 1, said water filled doors being hinged to said front partition, flexible hoses connected to couple the doors near their bottoms to receive water from a point low in the tank, and flexible hoses connected to couple the doors near their tops to deliver water to a point high in the tank to sustain flow by convection.

12. In a boiler as claimed in claim 11, pump means connecting the water filled doors with the tank to circulate water therebetween, and breather pipe means extending from the tops of the doors and opening to the atmosphere above the top of the tank.

13. In a boiler as claimed in claim 1, the boiler being covered on its outside surfaces with heat insulation, and the front partition having a deflector plate fixed thereto above the water filled doors and extending transversely across the boiler and disposed to deflect heat from the fire box away from the insulation when the doors are open.

14. In a boiler as claimed in claim 1, said front partition having adjustable air vent slots therethrough adjacent to the grate.

15. In a boiler as claimed in claim 1, said flue tubes each having an auger mounted therein and operative to cause the hot gases passing therethrough to swirl in the tubes.

16. In a boiler as claimed in claim 15, said augers being slidably inserted in the tubes and having removable support means maintaining them in the tubes out of contact with the walls of the tubes.

17. In a boiler as claimed in claim 1, a vent pipe extending through the top of the tank and open to the atmosphere, and automatic means to control the height of the water in the tank to a level just below the top thereof.

18. In a boiler as claimed in claim 1, pipe means connected near the top of the tank for withdrawing hot water therefrom, and return pipe means connected near the bottom of the tank for returning cooler water thereto, and a check valve in the return pipe means to prevent back-flow from the tank therethrough.

* * * * *